US009717272B2

(12) United States Patent
Patel et al.

(10) Patent No.: US 9,717,272 B2
(45) Date of Patent: Aug. 1, 2017

(54) CONTAINER FOR SMOKELESS TOBACCO PRODUCT

(71) Applicant: R.J. Reynolds Tobacco Company, Winston-Salem, NC (US)

(72) Inventors: Pankaj Patel, Clemmons, NC (US); David Troy Turfler, Collierville, TN (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 491 days.

(21) Appl. No.: 14/084,841

(22) Filed: Nov. 20, 2013

(65) Prior Publication Data

US 2015/0136618 A1 May 21, 2015

(51) Int. Cl.

| | |
|---|---|
| ***B65D 85/10*** | (2006.01) |
| ***A24F 23/00*** | (2006.01) |
| ***B65D 25/04*** | (2006.01) |
| ***B65D 81/22*** | (2006.01) |
| ***B65D 51/16*** | (2006.01) |
| ***B65D 81/26*** | (2006.01) |

(52) U.S. Cl.

CPC ..... *A24F 23/00* (2013.01); *B65D 25/04* (2013.01); *B65D 51/1622* (2013.01); *B65D 81/22* (2013.01); *B65D 81/26* (2013.01); *B65D 81/268* (2013.01)

(58) Field of Classification Search

CPC .. B65D 25/04; B65D 81/268; B65D 51/1622; B65D 81/22; B65D 81/26; A24F 23/00

USPC ..... 206/204, 236, 242, 265, 270; 131/274, 131/275, 328, 329; 220/554

See application file for complete search history.

(56) References Cited

U.S. PATENT DOCUMENTS

| | | | |
|---|---|---|---|
| 194,197 | A | 8/1877 | Villaret |
| 1,464,237 | A | 8/1923 | Beyer |

(Continued)

FOREIGN PATENT DOCUMENTS

| | | | |
|---|---|---|---|
| CH | 180218 | A | 10/1935 |
| DE | 77 33 213 | | 2/1978 |

(Continued)

OTHER PUBLICATIONS

Invitation to Pay Additional Fees for corresponding International Application No. PCT/US2014/066126 mailed Jan. 28, 2015.

*Primary Examiner* — Luan K Bui

(74) *Attorney, Agent, or Firm* — Womble Carlyle Sandridge & Rice, LLP

(57) ABSTRACT

A container that may be employed to store a tobacco-containing material is provided. The container may include a lower body portion and an upper lid. The lower body portion may include an intermediate bottom wall that may separate the lower body portion into upper and lower internal storage compartments. An environment modification material may be received in the lower internal storage compartment. The tobacco-containing material may be received in the upper internal storage compartment. The environment modification material may control humidity in the container to preserve the freshness of the tobacco-containing material and/or perform other functions. Vent channels cooperatively formed by the lower body portion and the upper cover may further contribute to humidity control.

19 Claims, 10 Drawing Sheets

(56) References Cited

U.S. PATENT DOCUMENTS 2,058,800 A * 10/1936 Jasper ..... A24F 25/02 206/205
2,074,122 A * 3/1937 Harris ..... A24F 25/02 312/31
2,090,530 A 8/1937 Guffey et al.
2,117,228 A 5/1938 Stuchbery
2,403,511 A 7/1946 Enkur
3,382,020 A * 5/1968 Meri ..... A24F 25/02 312/223.6
3,696,917 A 10/1972 Levi
3,782,584 A 1/1974 Swenson et al.
3,895,737 A 7/1975 Phillips
4,007,828 A 2/1977 Mayled
4,057,145 A 11/1977 Wray et al.
4,098,421 A * 7/1978 Foster ..... B65D 41/18 215/321
4,154,365 A 5/1979 Lorca
4,190,170 A 2/1980 Boyd
4,284,204 A 8/1981 Carey, Jr.
4,437,579 A 3/1984 Obland
4,561,544 A 12/1985 Reeve
4,572,376 A 2/1986 Wrennall
4,607,479 A 8/1986 Linden
4,611,727 A 9/1986 Graff
4,631,899 A 12/1986 Nielsen
4,646,933 A 3/1987 Jurczenia et al.
4,705,165 A 11/1987 Thieke
4,923,059 A * 5/1990 Evers ..... B65D 85/1045 206/204
5,108,006 A 4/1992 Tieke et al.
5,174,471 A 12/1992 Kozlowski et al.
5,275,291 A 1/1994 Sledge
5,443,853 A 8/1995 Hayes
5,657,901 A 8/1997 Farside
5,660,290 A 8/1997 Hayes
5,729,955 A 3/1998 Yamada
5,782,359 A 7/1998 McAllister et al.
5,794,771 A * 8/1998 Krawec ..... A24F 23/00 206/236
5,816,441 A 10/1998 Farside
5,850,839 A * 12/1998 Adami ..... A24F 25/00 206/204
5,897,025 A 4/1999 Flewitt et al.
5,909,822 A 6/1999 George et al.
5,915,560 A 6/1999 George et al.
6,032,792 A 3/2000 Faraj
6,131,765 A 10/2000 Barry et al.
6,155,454 A 12/2000 George et al.
6,162,516 A 12/2000 Derr
6,267,265 B1 7/2001 Issa
6,460,693 B1 10/2002 Harrold
6,527,138 B2 3/2003 Pawlo et al.
6,758,338 B2 7/2004 Lien
D495,545 S 9/2004 Niehues
6,863,175 B2 3/2005 Gelardi
6,913,149 B2 7/2005 Gelardi et al.
6,921,026 B2 * 7/2005 Saari ..... A23L 3/3418 239/53
6,976,576 B2 12/2005 Intini
7,159,720 B2 1/2007 Pearson
7,216,776 B2 5/2007 Gelardi
7,288,745 B2 10/2007 Colonna
7,353,969 B2 4/2008 McHutchinson
7,565,969 B2 7/2009 He
7,588,149 B2 9/2009 Gelardi
7,712,630 B2 5/2010 He
7,798,319 B1 * 9/2010 Bried ..... A24F 23/00 206/242
D625,178 S 10/2010 Bailey et al.
D631,353 S 1/2011 Gelardi et al.
D631,354 S 1/2011 Gelardi et al.
D631,747 S 2/2011 Gelardi et al.
D638,297 S 5/2011 Gelardi et al.
7,946,450 B2 5/2011 Gelardi et al.
D639,162 S 6/2011 Gelardi et al.
D639,163 S 6/2011 Gelardi et al.
D646,966 S 10/2011 Gill et al.
8,033,425 B2 10/2011 Gelardi
D649,284 S 11/2011 Patel et al.
8,066,123 B2 11/2011 Gelardi
8,087,540 B2 1/2012 Bailey et al.
8,096,411 B2 1/2012 Bailey et al.
D658,377 S 5/2012 Corwin et al.
D667,301 S 9/2012 Jones et al.
D667,302 S 9/2012 Jones et al.
D667,303 S 9/2012 Jones et al.
D667,304 S 9/2012 Jones et al.
D673,848 S 1/2013 Bailey et al.
D674,688 S 1/2013 Loftin et al.
D675,516 S 2/2013 Horton et al.
D676,321 S 2/2013 Jones et al.
D677,164 S 3/2013 Jones et al.
8,397,945 B2 3/2013 Gelardi et al.
8,458,996 B2 6/2013 Bried et al.
D687,300 S 8/2013 Jones et al.
D689,772 S 9/2013 Jones et al.
D690,588 S 10/2013 Pipes et al.
D692,298 S 10/2013 Pipes et al.
8,567,597 B2 10/2013 Gibson et al.
2001/0047977 A1 12/2001 Forman
2002/0096517 A1 7/2002 Gelardi
2002/0175195 A1 11/2002 Cole
2004/0131736 A1 * 7/2004 Pan ..... A23B 7/148 426/419
2004/0217024 A1 11/2004 Arnarp et al.
2005/0173272 A1 8/2005 Lemmons, IV
2006/0060480 A1 3/2006 Budd
2006/0118589 A1 6/2006 Arnarp et al.
2006/0124658 A1 6/2006 Coe et al.
2006/0243611 A1 11/2006 Wu
2007/0068960 A1 3/2007 Valentine et al.
2007/0102318 A1 5/2007 Gelardi et al.
2007/0110928 A1 5/2007 Bried et al.
2007/0163911 A1 7/2007 Gelardi
2007/0277299 A1 12/2007 Kroon
2008/0035643 A1 2/2008 Hoffman et al.
2008/0202956 A1 * 8/2008 Welk ..... B65D 43/0212 206/265
2008/0290110 A1 11/2008 Gelardi et al.
2009/0014450 A1 1/2009 Bjorkholm
2009/0223989 A1 9/2009 Gelardi
2009/0266837 A1 10/2009 Gelardi et al.
2010/0012534 A1 1/2010 Hoffman
2010/0018882 A1 * 1/2010 St. Charles ..... A24B 13/00 206/242
2010/0018883 A1 1/2010 Patel
2010/0059539 A1 3/2010 Giraud et al.
2010/0065076 A1 3/2010 Bergstrom et al.
2010/0065077 A1 3/2010 Lofgreen-Ohrn et al.
2010/0084424 A1 4/2010 Gelardi
2010/0133140 A1 6/2010 Bailey et al.
2010/0264157 A1 10/2010 Bailey et al.
2010/0307113 A1 12/2010 Bried et al.
2011/0000931 A1 1/2011 Gelardi et al.
2011/0318460 A1 12/2011 Jensen et al.
2012/0193265 A1 8/2012 Patel et al.
2013/0146610 A1 6/2013 Gelardi et al.
2014/0027325 A1 1/2014 Takeuchi et al.
2014/0069829 A1 * 3/2014 Evans ..... A24F 23/02 206/265

FOREIGN PATENT DOCUMENTS

EP 2 454 953 5/2012
GB 686 870 A 2/1953
GB 2 042 476 A 9/1980
WO WO 99/48391 A1 9/1999
WO WO 03/000566 1/2003
WO WO 2004/035404 A1 4/2004
WO WO 2005/035390 A1 4/2005
WO WO 2007/017761 A2 2/2007
WO WO 2007/067953 A2 6/2007

(56) References Cited

FOREIGN PATENT DOCUMENTS

| | | |
|---|---|---|
| WO | WO 2008/070032 A2 | 6/2008 |
| WO | WO 2010/060723 | 6/2010 |
| WO | WO 2010/066510 | 6/2010 |
| WO | WO 2012/131989 | 10/2012 |

* cited by examiner

CONTAINER FOR SMOKELESS TOBACCO PRODUCT

FIELD OF THE DISCLOSURE

The present disclosure relates to containers and methods of use thereof. More particularly, this disclosure relates to packaging for products made or derived from tobacco, or that otherwise incorporate tobacco, and are intended for human consumption.

BACKGROUND OF THE DISCLOSURE

Tobacco may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; U.S. Pat. No. 8,336,557 to Kumar et al.; and U.S. Pat. No. 8,469,036 to Strickland et al.; U.S. Pat. Pub. Nos. 2004/0020503 to Williams; 2006/0191548 to Strickland et al.; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2008/0305216 to Crawford et al.; 2009/0065013 to Essen et al.; 2010/0291245 to Gao et al. and 2013/0206153 to Beeson et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA.

Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

Various types of containers for dispensing moistened solid components, particularly components intended for human consumption, are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; D574,709 to Crotts et al. and D649,284 to Patel et al.; U.S. Patent Pub. Nos. 2008/0202956 to Welk et al., 2010/0012534 to Hoffman, and 2010/0018883 to Patel et al.; and U.S. patent application Ser. No. 13/739,776, filed Jan. 11, 2013, to Pipes et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety.

A desirable feature for certain containers is the protection of the product from environmental effects, particularly those effects that may degrade the product stored in the container. For example, in humid environments, moisture may invade the storage space housing the product within a sealed container, thereby damaging the product or otherwise rendering the product unusable. In other instances, venting within the enclosure formed by the sealed container may be needed for properly storing a product. Even though a container may contain venting features, it still would be highly desirable to provide certain means for ensuring a controlled environment within that sealed container.

It would thus be desirable to provide packaging for smokeless tobacco products and the like, wherein the packaging is aesthetically pleasing and provides various advantageous features, such as protection of packaged smokeless tobacco product from various environmental effects.

BRIEF SUMMARY OF THE DISCLOSURE

The present disclosure relates to a container that, in certain embodiments, combines aesthetics and environmental protection of a product contained therein, and which can be provided in a convenient handheld size. The type and form of the product to be stored can vary, but preferably is a tobacco-containing material, such as a smokeless form tobacco product.

In one embodiment, the container includes two pieces, with one piece defining a lower portion or body, and a second piece that defines a top cover or lid. The top lid is adapted to fit over the top region of the lower body, and hence provide for a sealed container. The top lid also is adapted to be removable from the lower body, and hence allow access to product (e.g., smokeless tobacco material, such moist snuff type of smokeless tobacco) that is positioned inside the upper region of the lower body. The lower body possesses a bottom wall, and intermediate bottom wall located above the bottom and upwardly extending side wall features.

The bottom wall and side wall define a lower internal storage region or compartment that is adapted for location of environment modification material (e.g., a humidity control material). That is, the lower compartment is a hollow region within the bottom region of the lower body into which the environment modification material can be positioned. The intermediate bottom wall and the side wall also define an upper internal storage region or compartment that is adapted for location of product (e.g., smokeless tobacco material). Most preferably, the lower body is designed so that the intermediate bottom wall and the side wall features of both the upper and lower compartments are considered to be integral with one another. Most preferably, the lower compartment is significantly enclosed by the configuration of the bottom, the intermediate bottom and the side walls of the lower body; while the arrangement of the intermediate bottom and side walls of lower body are such that the top region of the lower body is open to expose tobacco product that is positioned within the upper storage region.

Additionally, the format and configuration of the intermediate wall is such that the tobacco product and the environment modification material are physically separated from one another. The lower body of the container possesses side wall features that have an outer peripheral surface configured in its upper region to allow removable engagement of the top cover. The top cover possesses top wall and downwardly extending side wall features, and as such the top cover is configured to be removably engaged with the lower body. The top cover also possesses inner top and side surfaces, the inner side surface configured to be received over and interact with the outer peripheral surface of the side wall of the lower body so as to form an interference fit. Additionally, the intermediate bottom wall may be adapted to allow for atmosphere within the lower body to pass between the lower and upper internal storage regions; and as such, when the container is sealed, the atmosphere experienced by the tobacco product is affected by the physically separated environment modification material.

In one regard, the container comprises a lower portion or body (which preferably is manufactured from a polymeric material), and that lower body possesses bottom, intermediate bottom and side wall features of the type set forth hereinbefore. In such an embodiment, a circumferential rib structure is integrally formed with the lower body about the outer peripheral surface of the side wall and extends radially outwardly therefrom. The rib structure may include a plurality of ribs extending circumferentially about the outer peripheral surface of the side wall. The ribs are spaced apart so as to form channels therebetween for facilitating venting when the container is sealed. An upper cover is configured to be removably engaged with the lower body. The cover (which preferably is manufactured using metallic material) includes a top wall and a peripheral flange having a cylindrical inner surface. The cylindrical inner surface is substantially smooth and is configured to interact with the rib structure when that cover is received over the outer peripheral surface of the side wall so as to form an interference fit. Tobacco-containing material (e.g., moist snuff or snus types of smokeless tobacco products) is positioned in the upper compartment of the lower body, and the environment modification material is positioned within the lower compartment of the lower body. When sealed, the configuration of the engagement of the top lid and lower body are such that venting of the sealed container is permitted, and the environment within the sealed container is affected by the presence of the environment modification material. For example, the environment modification material can be selected so as to provide for control of humidity within the sealed container.

In yet another regard, one embodiment possesses a lower body of the type set forth hereinbefore, and that lower body (which preferably is manufactured from a polymeric material), possesses a cylindrically shaped side wall having an edge. The internal storage compartment has an opening thereto adjacent to the edge of the side wall, wherein an outer peripheral surface of the side wall includes a neck region of reduced diameter proximal to the edge of the side wall such that the side wall defines a lip. A circumferential rib structure is integrally formed with the lower body about the outer peripheral surface of the side wall in the neck region and projects radially outwardly therefrom. The rib structure includes a plurality of rib segments extending circumferentially about the outer peripheral surface of the side wall. The rib segments are spaced apart so as to form vent channels therebetween and each rib segment includes a rib wall projecting radially from the outer peripheral surface of the body and a rib projection projecting radially from the rib wall. Each vent channel is at least partially defined by adjacent rib walls and the outer peripheral surface of the side wall of the lower body. A cover (which preferably is manufactured using a metallic material) is configured to be removably engaged with the lower body. The cover has a top wall and a peripheral flange having a cylindrical inner surface. The cylindrical inner surface is substantially smooth and is configured to interact with the rib structure when the cover is received over the neck region of the side wall so as to form an interference fit, and wherein the cover is configured to abut the lip of the side wall of the lower body when the cover is fully seated on that body. When sealed, the configuration of the engagement of the top lid and lower body are such that venting of the sealed container is permitted, and the environment within the sealed container is affected by the presence of the environment modification material. For example, the environment modification material can be selected so as to provide for control of humidity within the sealed container. Typically, the intermediate bottom wall is adapted to possess at least one air passageway that allows the atmosphere within the upper compartment of the container to be affected the environment modification material positioned within the lower compartment. For example, a plurality of small holes or perforations within the intermediate bottom wall allow for air passage between the two compartments, but also provides for maintenance of the physically separate positioning the components of the upper and lower compartments (and hence minimizes or prevents effects of cross contamination of the respective components of those compartments).

Accordingly, in one aspect, a container for a tobacco-containing material is provided. The container may include a lower body portion and a top cover, the lower body portion comprising a bottom wall, an intermediate bottom wall located above the bottom wall, and a side wall extending upwardly therefrom, the bottom wall and the side wall of the lower body portion defining a lower internal storage compartment adapted for receipt of an environment modification material, the intermediate bottom wall and the side wall of the lower body portion defining an upper internal storage compartment configured to receive a tobacco-containing material, the intermediate bottom wall being adapted to allow for atmosphere within the lower body portion to pass between the lower internal storage compartment and the upper internal storage compartment, the side wall of the lower body portion having an outer peripheral surface, the outer peripheral surface being configured at an upper portion to allow removable engagement of the top cover, the top cover having a top wall and a side wall extending downwardly therefrom, the top cover being configured to be removably engaged with the lower body portion, the side wall of the top cover having an inner surface, the inner surface being configured to be received over and interact with the outer peripheral surface of the side wall of the lower body portion so as to form an interference fit.

In some embodiments, the lower body portion may be a polymeric material, and the top cover may be a metallic material. The lower body portion may further include a rib structure, the intermediate bottom wall and the rib structure each being integrally formed with the side wall of the lower body portion. The outer peripheral surface of the side wall of the lower body portion may define a lip, the rib structure being positioned adjacent to the lip such that a peripheral flange of the top cover interacts with the lip to form a stop when the top cover is received over the outer peripheral surface of the side wall of the lower body portion. The peripheral flange may include a substantially planar edge configured for abutting contact with a substantially planar surface of the lip when the top cover is fully seated upon the lower body portion. The side wall and the peripheral flange of the lower body portion may be substantially cylindrical, and the rib structure may extend circumferentially about the outer peripheral surface of the side wall of the lower body portion. The rib structure may include a plurality of rib segments projecting from the outer peripheral surface of the side wall of the lower body portion, the rib segments may be spaced apart so as to form vent channels therebetween for facilitating venting when the top cover is received over the lower body portion. Each of the rib segments may include a rib wall and a rib projection projecting from the rib wall, the rib wall being adjacent the outer peripheral surface of the side wall of the lower body portion, and the rib projection extending outwardly of the rib wall and being configured to interact with the inner surface of the peripheral flange when the top cover is received over the outer peripheral surface of the side wall of the lower body portion. The container may additionally include at least one of a plurality of pouched smokeless tobacco products and a tobacco material in the form of moist snuff received in the upper internal storage compartment. The environment modification material may be a humidity control material.

In an additional aspect, a container defining a modified internal environment is provided. The container may include a cover, a body portion configured to engage the cover to substantially enclose an internal space defined by the body portion, the body portion including an intermediate wall that divides the internal space into a first compartment and a second compartment, and an environment modification material received in the second compartment and configured to act through the intermediate wall upon an atmosphere within the first compartment.

In some embodiments the body portion may further include a side wall and a bottom wall, the second compartment being defined by the side wall, the bottom wall, and the intermediate wall. The cover may be configured to releasably engage the body portion and the intermediate wall and the bottom wall may be irreleasably (e.g., permanently) secured to the side wall. The intermediate wall may include a plurality of through holes extending therethrough. The environment modification material may be configured to affect a humidity level within the first compartment. The cover may cooperate with the body portion to define a plurality of vent channels extending between the first compartment and an external atmosphere.

In a further aspect, a packaged tobacco product is provided. The packaged tobacco product may include a cover and a body portion engaged with the cover. The body portion may define a first compartment including a tobacco-containing material received therein and a second compartment including an environment modification material received therein and configured to act upon an atmosphere within the first compartment.

In some embodiments the body portion may include a side wall, a bottom wall, and an intermediate wall, wherein the intermediate wall separates the first compartment and the second compartment. The intermediate wall may include a plurality of through holes extending therethrough. The cover may be releasably secured to the body portion and the intermediate wall and the bottom wall may be irreleasably (e.g., permanently) secured to the side wall. The environment modification material may be configured to affect a humidity level within the first compartment. The cover may cooperate with the body portion to define a plurality of vent channels extending between the first compartment and an external atmosphere.

These and other features, aspects, and advantages of the disclosure will be apparent from a reading of the following detailed description together with the accompanying drawings, which are briefly described below.

BRIEF DESCRIPTION OF THE DRAWINGS

Figure 1:
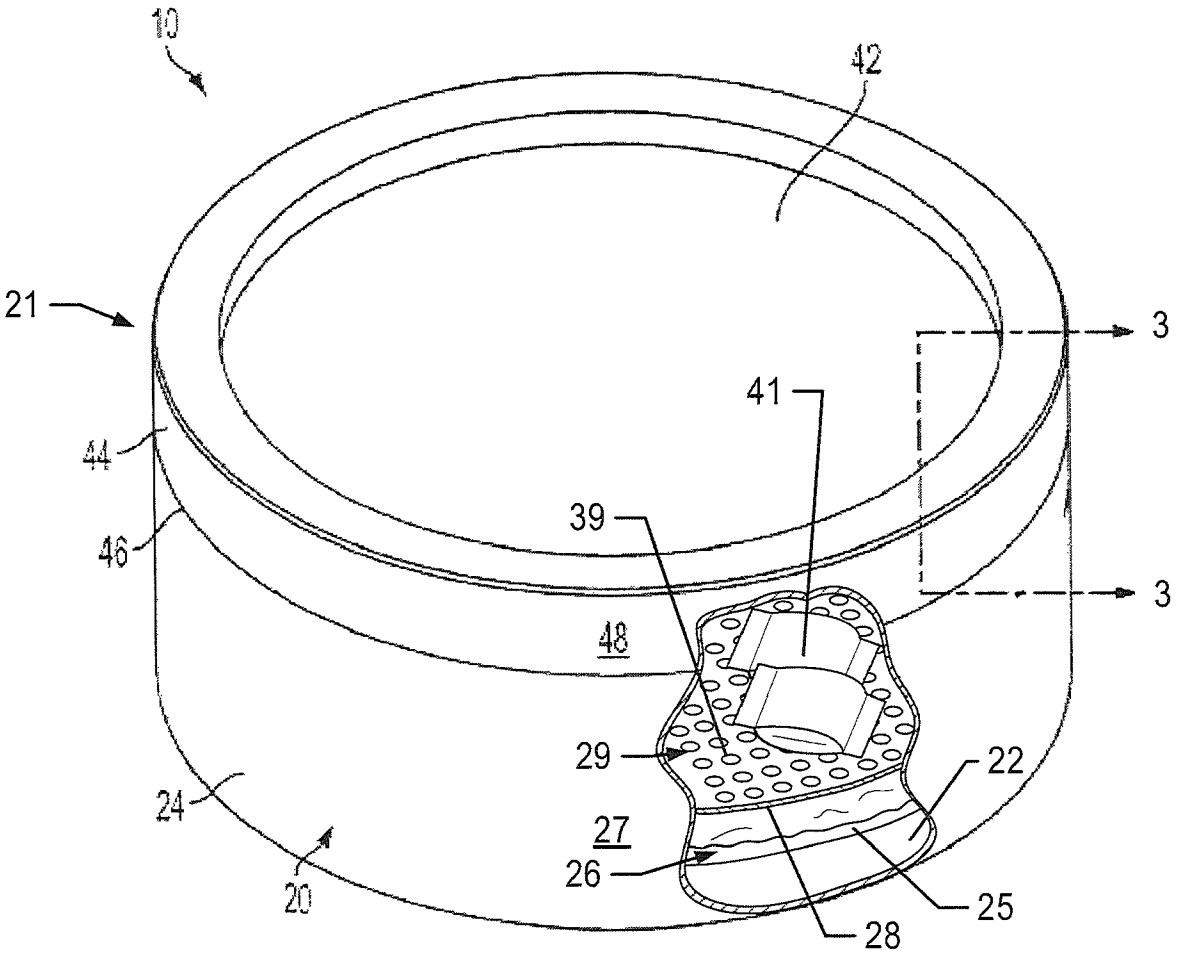
Figure 2:
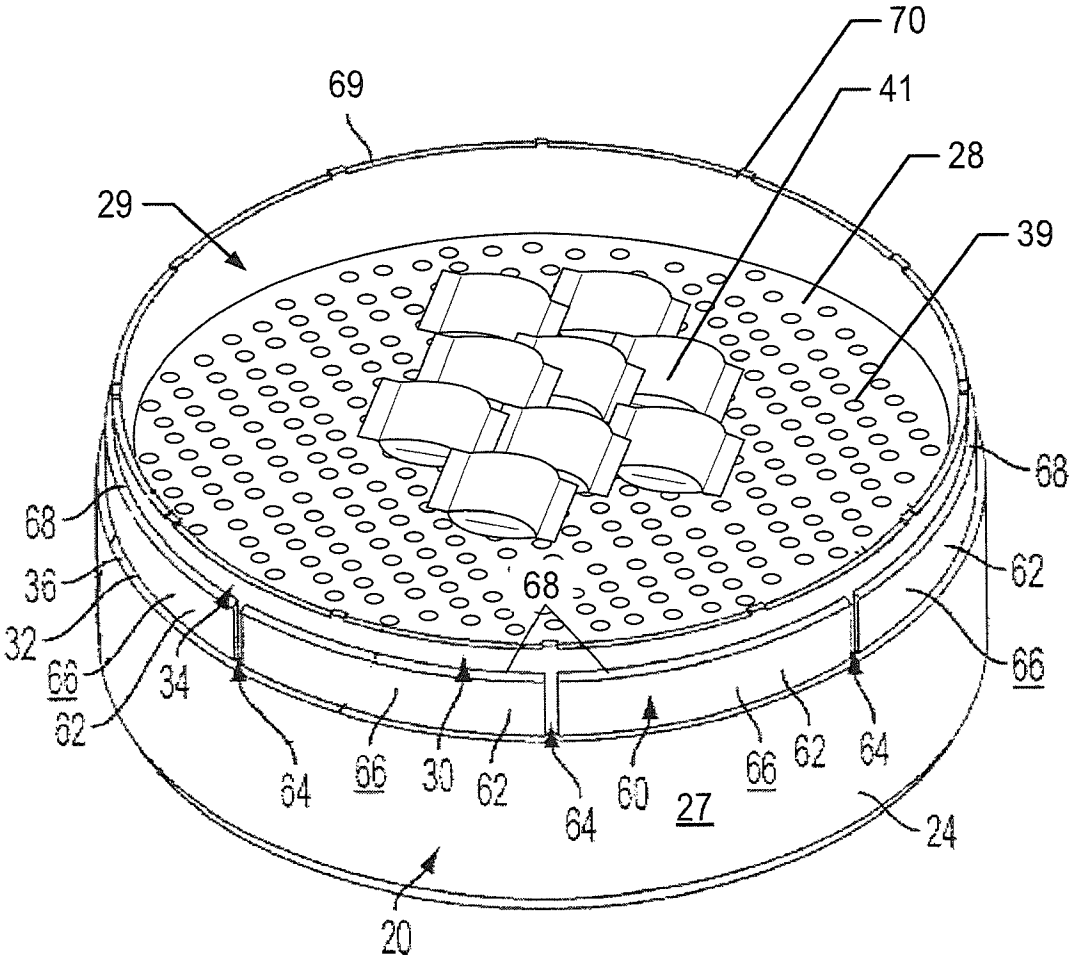
Figure 3:
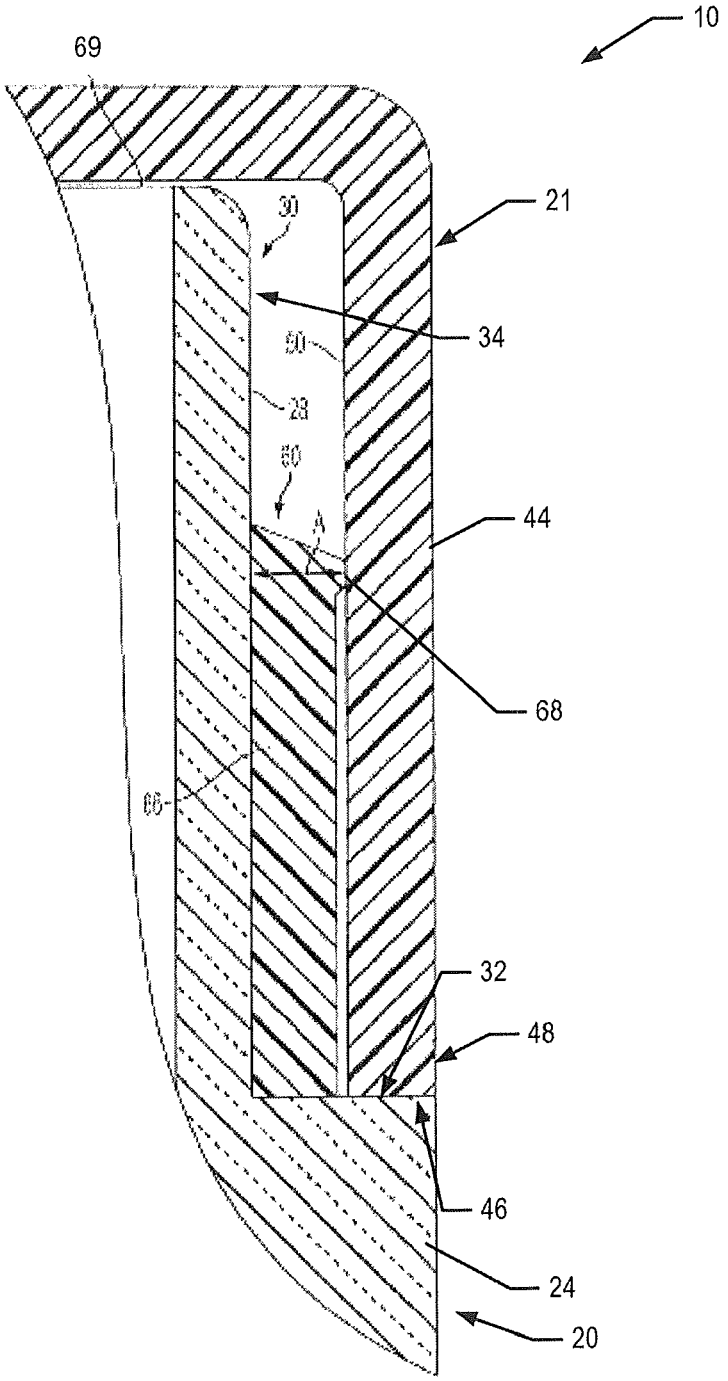
Figure 4:
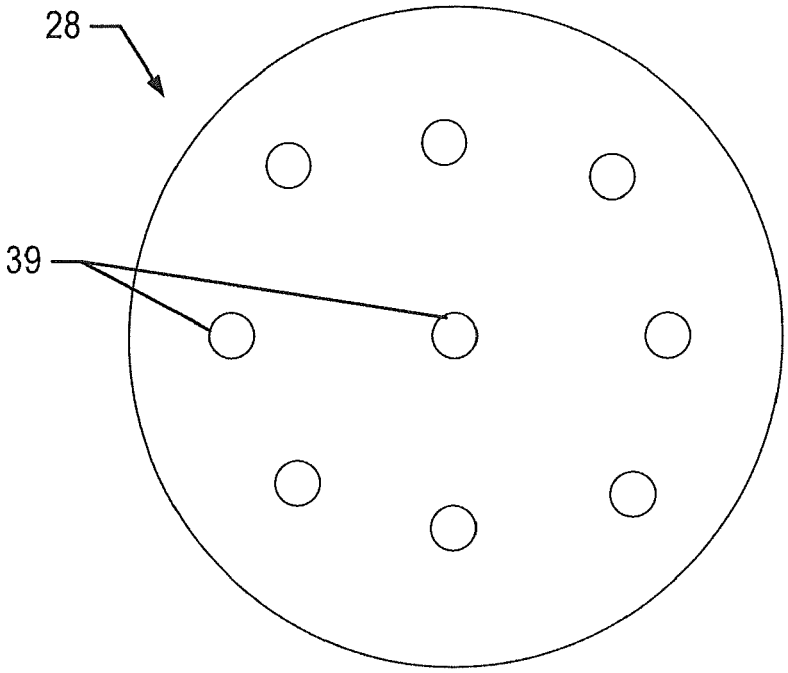
Figure 5:
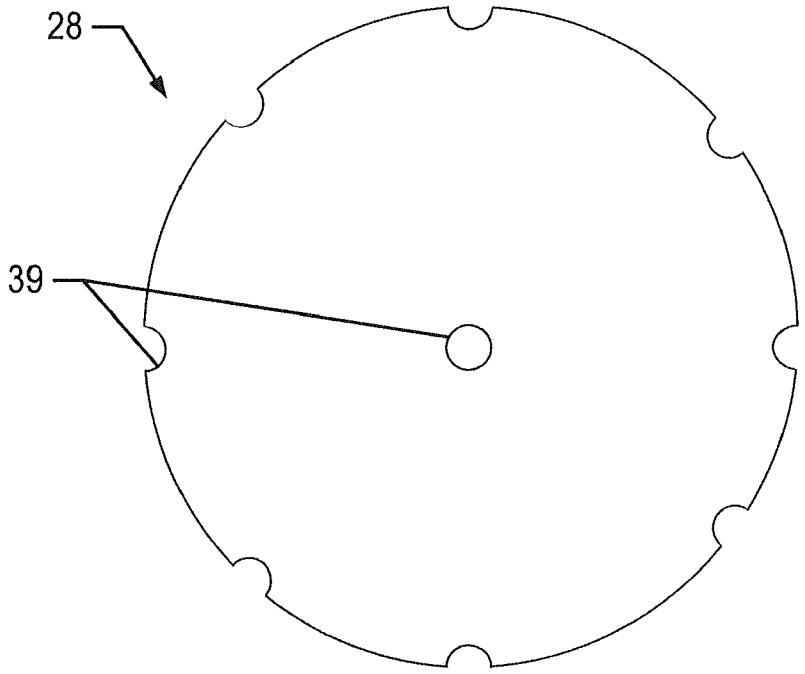
Figure 6:
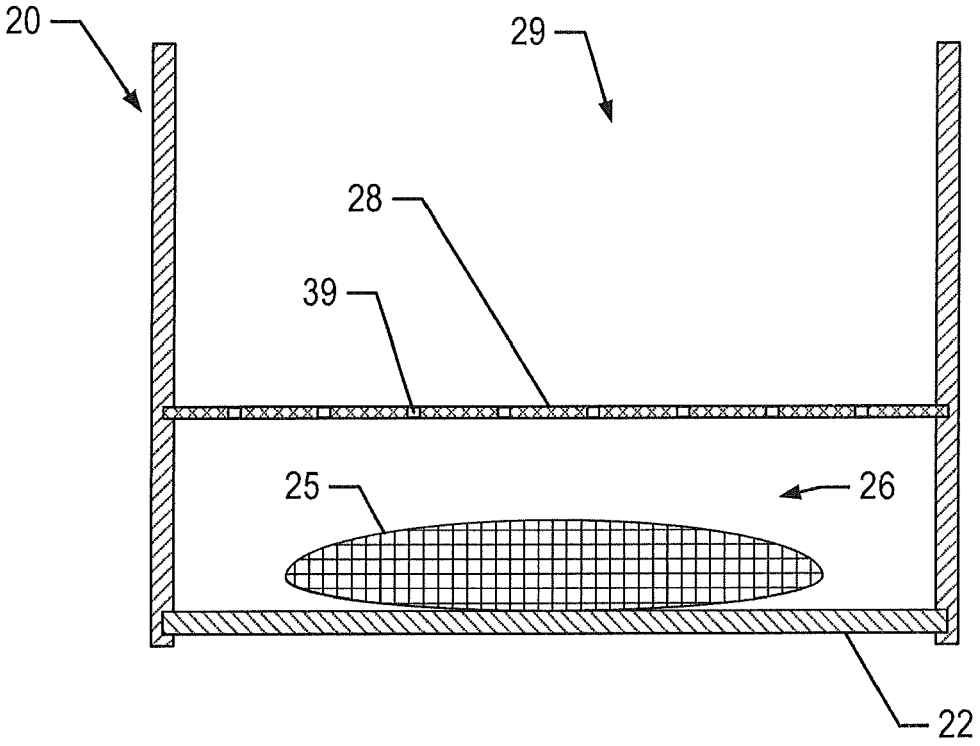
Figure 7:
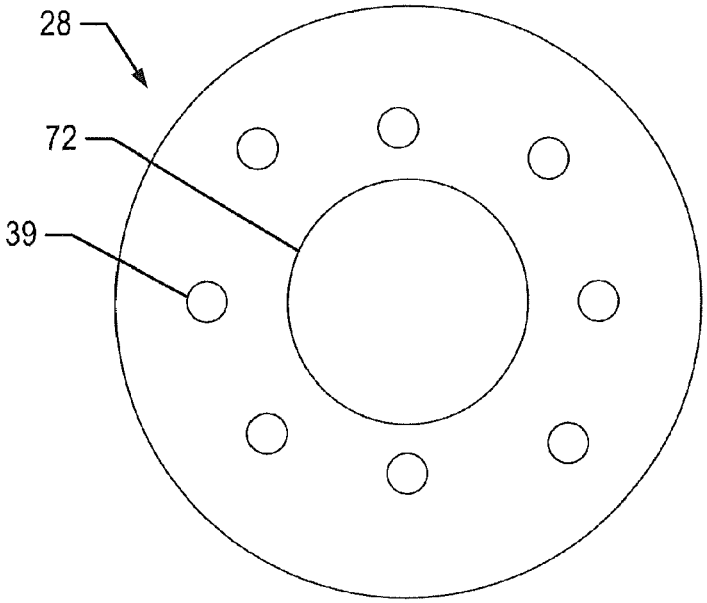
Figure 8:
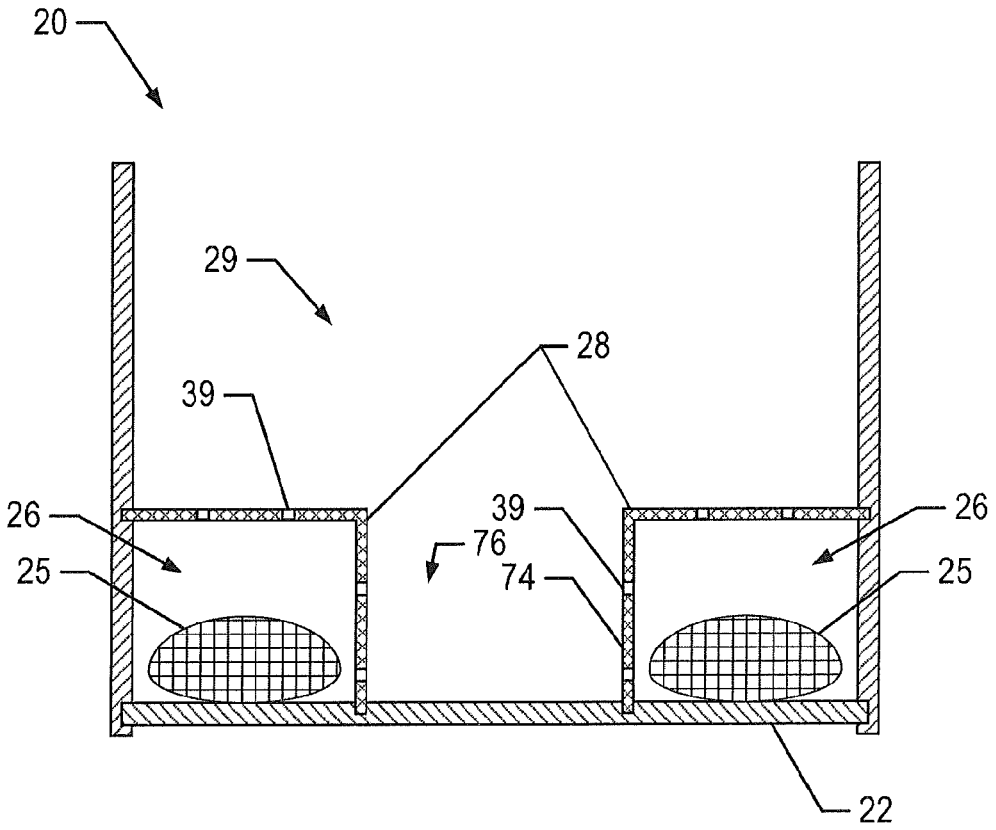
Figure 9:
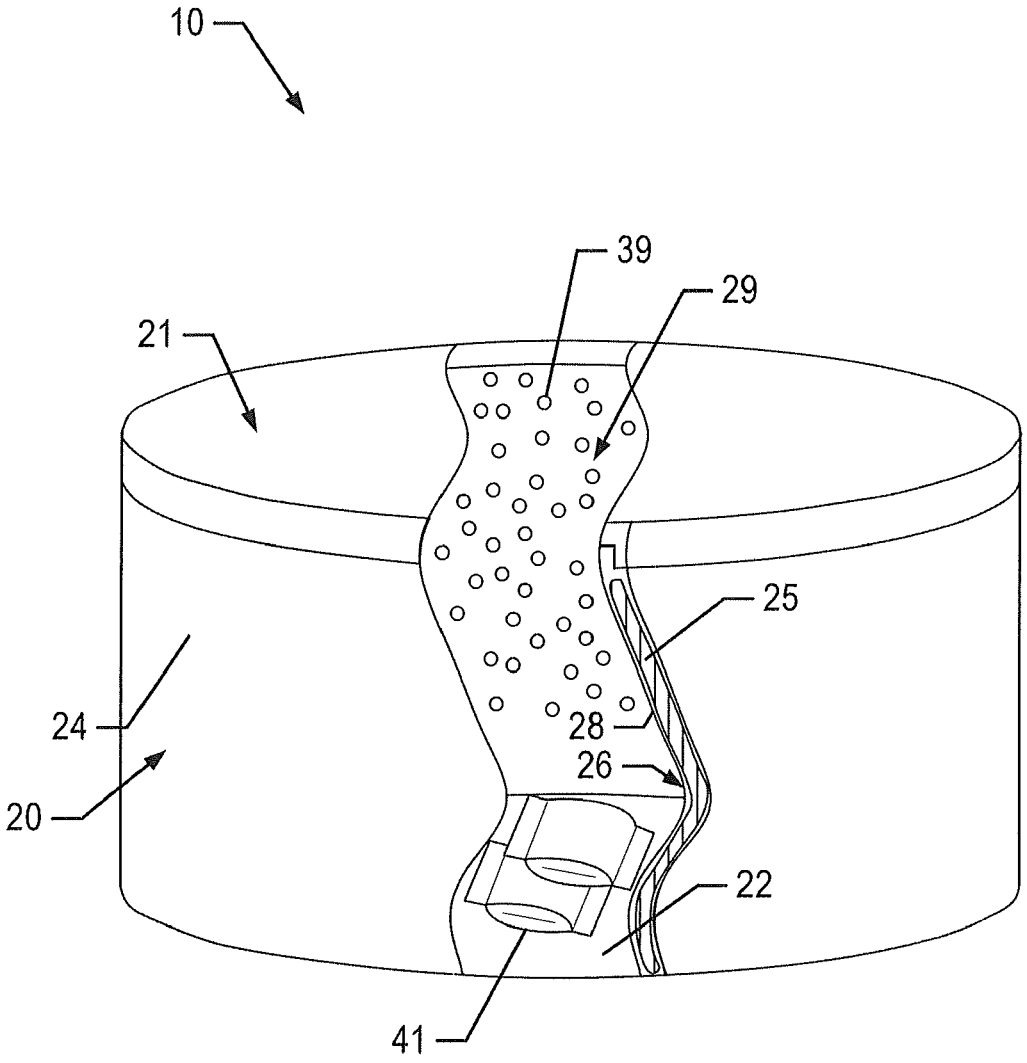
Figure 10:
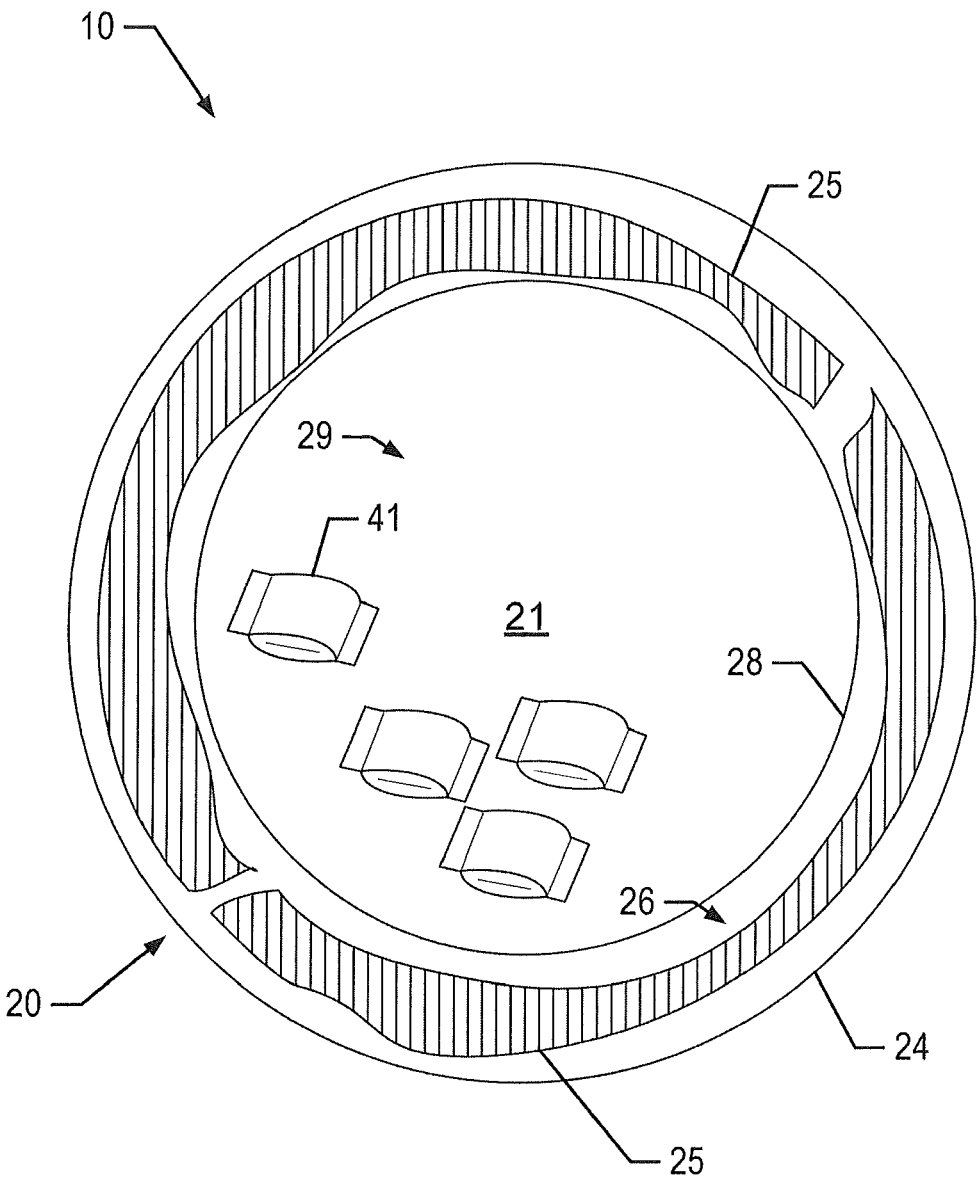
Figure 11:
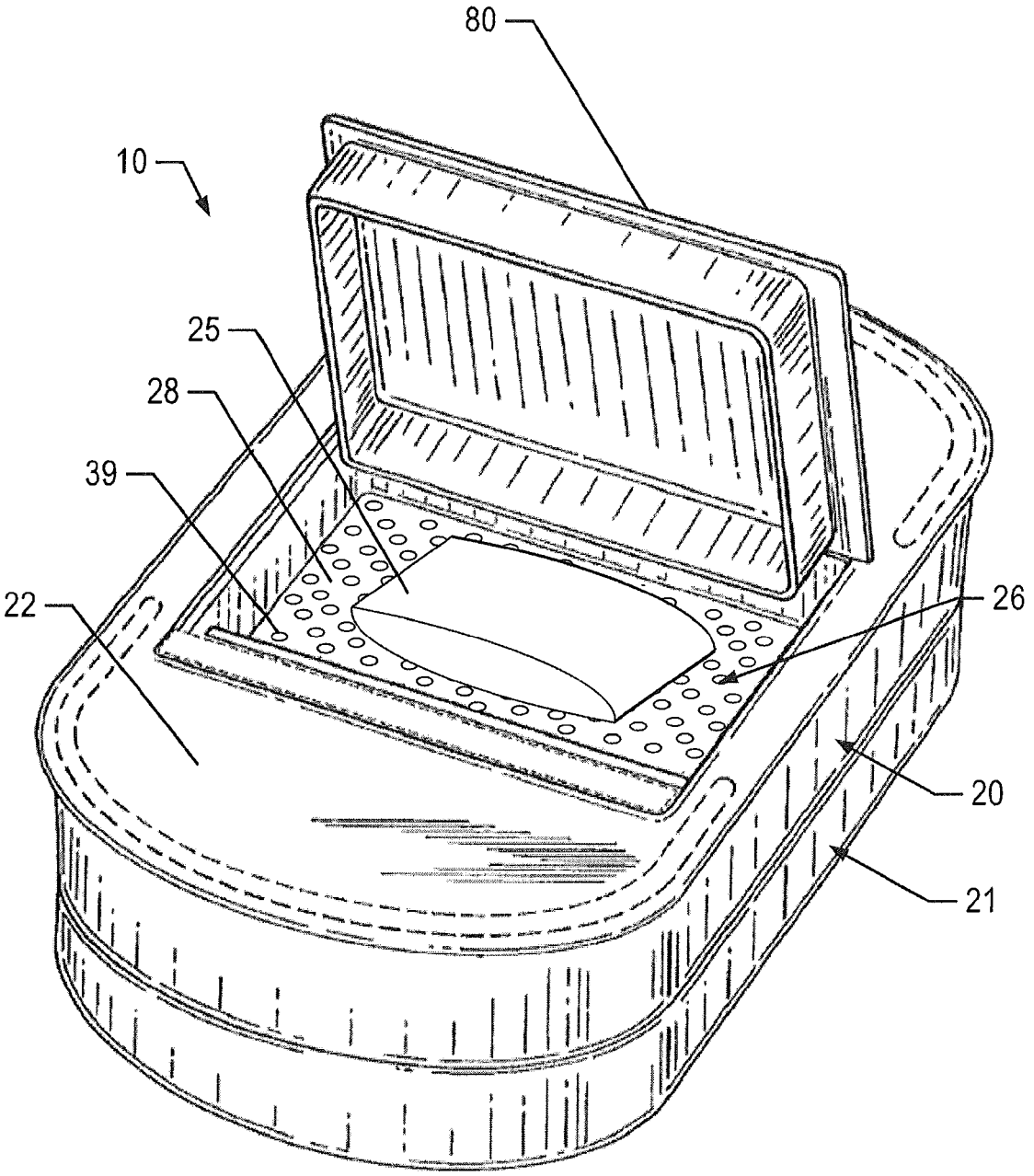

Having thus described the disclosure in general terms, reference will now be made to the accompanying drawings, which are not necessarily drawn to scale, and wherein:

FIG. 1 is a perspective view of a sealed container including an intermediate wall with perforations representative of an embodiment of the present disclosure, which is shown as partially cut away;

FIG. 2 is a perspective view of a lower body of a container embodiment according to the present disclosure;

FIG. 3 is a magnified sectional view on the line 3-3 of FIG. 1;

FIG. 4 is a top view of the intermediate wall of the body of the container showing a representative configuration of the perforations in that wall according to an example embodiment of the present disclosure;

FIG. 5 is a top view of the intermediate wall of the body of the container showing an alternate representative configuration of the perforations in that wall at the peripheral edge thereof according to an example embodiment of the present disclosure;

FIG. 6 is a side sectional view that illustrates the connection of the bottom wall to the remaining portion of the bottom body of the container according to an example embodiment of the present disclosure;

FIG. 7 is a top view of the intermediate wall of the body of the container showing an alternate representative configuration including an open center according to an example embodiment of the present disclosure;

FIG. 8 illustrates a side sectional view through an embodiment of the container including the intermediate wall of FIG. 7 according to an example embodiment of the present disclosure;

FIG. 9 is a partial cut-away perspective view of a container including a compartment containing an environment modification material surrounding the periphery of a compartment containing a tobacco-containing material;

FIG. 10 illustrates a bottom sectional view through the container of FIG. 9; and FIG. 11 is a perspective view of an alternative embodiment of the present disclosure, showing an inverted container that has its body sealed to its lid, and the bottom portion of the container in an open position.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

The container embodiments described herein can be used to store various solid products, but are particularly well-suited for products designed for oral consumption. Exemplary consumable products that are often packaged in such containers include a wide variety of moist consumer products, including tobacco products of the type that have a smokeless form. Various forms of suitable smokeless tobacco products are those types products set forth and described generally in U.S. Patent Pub. Nos. 2012/0193265 to Patel et al. and 2013/0206153 to Beeson et al.; which is incorporated by reference herein. Of particular interest, are exemplary tobacco products that include tobacco formulations in a loose form, such as moist snuff products. Other exemplary types of smokeless tobacco products include the types of products set forth in U.S. Pat. No. 2012/0024301 to Carroll et al., which incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

The shape of the outer surface of the containers of the disclosure can vary. Although the container embodiments illustrated in the drawings have certain contours, containers with other exterior surface designs also can be suitably adapted and used. For example, the sides or edges of the containers of the disclosure can be flattened, rounded, or beveled, and the various surfaces or edges of the container exterior can be concave or convex. Further, the opposing sides, ends, or edges of the container can be parallel or non-parallel such that the container becomes narrower in one or more dimensions. See, for example, the types of containers, components, component arrangements and configurations, and constructions thereof set forth in U.S. Pat. No. 8,458,996 to Bried et al. and D649,284 to Patel et al.; U.S. Patent Pub. Nos. 2010/0018883 to Patel et al.; and U.S. patent application Ser. No. 13/739,776, filed Jan. 11, 2013, to Pipes et al.; as well as the various types of containers referenced in U.S. Patent Pub. No. 2013/0206153 to Beeson et al.; each of which are incorporated by reference herein.

The dimensions of the containers described herein can vary without departing from the disclosure. However, in highly preferred embodiments, the containers can be described as having a cylindrical size suitable for handheld manipulation and operation. Exemplary dimensions for such handheld generally cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is comparable in many regards to that have been used for commercially available GRIZZLY and KODIAK products that are marketed by American Snuff Company, LLC.

Further, the size of the containers described herein may be changed. For example, the containers may be sized for promotional purposes by providing either increased or decreased dimensions. For example, the dimensions of the containers may be scaled upwardly or downwardly by certain multipliers. By way of further example, the dimensions of the container may be scaled upwardly or downwardly by a multiple of about 1 to about 10 times. In this regard, whereas a conventional container according to embodiments of the present disclosure may be configured to store about 1.2 ounces of a tobacco-containing material, an oversized container may be configured to store, for example, 2.4 ounces or 7.2 ounces of the tobacco containing material. In specialty markets the containers may define a larger cylindrical configuration having a diameter from about 100 mm to about 125 mm (e.g., preferably about 114 mm) and a depth from about 30 mm to about 50 mm (e.g., preferably about 38 mm). Accordingly, the dimensions and capacities disclosed herein are provided for example purposes only and may be modified to suit particular purposes.

Referring to FIG. 1, there is shown an embodiment of one type of container 10 which is representative of the present disclosure. The representative generally cylindrical container 10 may be formed by an open-ended lower body or body portion 20 and a lid or cover 21. The body portion 20 has a bottom wall 22, which in some instances, may be substantially planar; and side wall 24 which, depending from the shape of bottom wall 22 has configuration features which, in some instances, may be generally cylindrical (as shown). The side wall 24 defines a peripheral portion of the container 10 such that the side wall 24 includes an outer peripheral surface 27. The bottom wall 22 and the side wall 24 cooperate to define a sealed lower internal storage compartment 26 for storage of environment modification material 25. The lower internal storage compartment 26 also possesses a top wall provided by an intermediate wall 28 (e.g., an intermediate bottom wall, or false bottom), which also may be substantially planar, that is engaged with the side wall 24 upwards from the bottom wall 22 and towards an upper region or portion 30 of the body portion 20 (see, FIG. 2). As such, the lower internal storage compartment 26 is enclosed by the configuration of the bottom wall 22, the side wall 24 and the intermediate bottom wall 28. For the embodiment shown, the configuration of the lower body portion 20 is such that both the bottom wall 22 and the intermediate bottom wall 28 are generally planar, and those two walls are arranged so as to be essentially parallel to one another. For the embodiment shown, the configuration of the body portion 20 also is such that the side wall 24 and the intermediate bottom wall 28 form an open-ended, generally cylindrical upper internal storage region or compartment 29. Thus, the body portion 20 may include first (e.g., the upper internal storage compartment 29) and second (e.g., the lower internal storage compartment 26) compartments.

The intermediate bottom wall 28 possesses at least one aperture, through hole, perforation, or air passageway 39, or is otherwise adapted to allow for atmosphere within the lower storage compartment 26 to pass between that compartment and the upper internal storage compartment 29. The air passageways may be formed in the intermediate bottom wall 28 or punched or otherwise removed therefrom. The size, number and positioning of the perforations 39 in the intermediate bottom wall 28 are such that the intended effects of the environment modification material 25 located in the lower internal storage compartment 26 can act upon the atmosphere within the upper internal storage compartment 29. The perforations 39 also are configured so as to allow the contents of the lower storage compartment 26 (e.g., the environment modification material 25) to be physically separated from the upper internal storage compartment 29. In this regard, the intermediate wall 28 may comprise a screen, a permeable membrane, or any other barrier configured to prevent physical contact between the contents of the upper internal storage compartment 29 and the contents of the lower internal storage compartment 26 while allowing the environment modification material 25 to affect the atmosphere within the upper internal storage compartment.

The cover 21 is configured to allow for enclosure of a tobacco-containing material 41 (e.g., a smokeless tobacco product) positioned within the upper internal storage compartment 29. In this regard, the cover 21 is typically removably secured to the upper region 30 of body 20 by a snap-fit or an interference fit. A representative cover 21 has a top wall 42, which, in some instances, may be substantially planar, and a peripheral flange 44 depending from the top wall 42 which is shown as being cylindrical, and a lower edge 46. The peripheral flange 44 of the cover 21 is received over the side wall 24 of the body 20 so as to form an enclosure therebetween. The representative peripheral flange 44 possesses an outer surface 48, and preferably includes a substantially flat or smooth inner surface 50 (see, FIG. 3). That is, the inner surface 50 of the representative cover 21 typically does not include any protrusions, projections, ribs, or the like for interacting with the outer peripheral surface 27 of the side wall 24 of the lower body 20. In this regard, the inner surface 50 is substantially smooth and continuous about the cylindrical configuration of the peripheral flange 44.

The material of construction of the body portion 20 of the container 10 can vary. Exemplary preferred materials include metal and synthetic plastic materials. Polymeric materials that can be extruded and/or molded into desired shapes are typically utilized, such as polypropylene, polyethylene, polystyrene, polyamide, and the like. For example, plastic materials may be injection molded to form the body portion 20. Exemplary preferred body portions are those that incorporate polymeric materials such as those types of plastic-type materials commonly used for popular types of smokeless tobacco products. For example, exemplary body portions formed from polymeric materials are comparable components and general structure to those used for commercially available CAMEL Snuff, GRIZZLY and KODIAK products that are marketed by American Snuff Company, LLC. Various metallic materials may additionally or alternatively be employed to form the body portion 20 of the container 10. Metallic body portions formed from metallic materials are available from J. L. Clark of Rockford, Ill., Crown Cork and Seal of Philadelphia, Pa., and Independent Can of Belcamp, Md. The metallic materials may include tinplate or tinplated steel in some embodiments.

The manner by which the body portion 20 of the container 10 is manufactured can vary. As discussed hereinafter, the intermediate bottom wall 28 and/or the bottom wall 22 may be substantially irreversibly (e.g., irreleasably and permanently) attached to the remainder of the body portion 20. In a highly preferred embodiment, the intermediate bottom wall 28 and the side wall 24 that defines the side walls of the upper and lower compartments 29, 26 are integral with one another. As such, those components of the body portion 20 are manufactured as one piece. In one embodiment the intermediate bottom wall 28 and the side wall 24 may be joined by injection molding or any of the various other formation and coupling techniques discussed herein.

In a preferred embodiment, the body portion 20 is formed from a polymeric material, while the cover or lid 21 is formed from a metallic material such as, for example, aluminum or tinplate. Such a configuration is advantageous in that it provides an aesthetically appealing appearance by using a metallic cover 21 (which is typically stamped), while also allowing the body to be less expensively produced using, for example, an injection molding process. In this manner, a rib structure (as further described below) may be more easily and less expensively applied to the body 20 (i.e., via plastic injection molding instead of metallic stamping). Exemplary covers formed from metallic materials are those used for commercially available CAMEL Snuff, GRIZZLY and KODIAK products that are marketed by American Snuff Company, LLC. If desired, the cover can be manufactured from polymeric materials, such as polymeric materials identical to those used to produce the body portion.

An exemplary cover 21 can be manufactured from iron or steel, which can be plated with a thin layer of tin, and then overcoated with primers, epoxy laquers, and the like. If desired, a thin layer of thermoplastic (e.g., polyethylene taraphalate or polypropylene) can be applied over epoxy laquer coated tin plated steel.

Accordingly, the container 10 may be formed from various materials including, for example, metal and/or plastic. In some embodiments the container may optionally include a gasket configured to seal the connection between the cover 21 and the body portion 20 as disclosed, for example, in U.S. Pat. No. 8,458,996 to Bried et al. or U.S. patent application Ser. No. 13/739,776, filed Jan. 11, 2013, to Pipes et al., which are incorporated herein by reference in their entireties.

Further, in one embodiment the body portion 20 and/or the cover 21 may be formed from two or more materials. For example, in one embodiment the body portion 20 may comprise a plastic insert or liner inside of a metal outer body. This body portion may be combined with a metal cover 21 such that the container appears to be all metal when the exterior thereof is viewed. Use of plastic inserts in metal outer body is employed in CAMEL Snus, as marketed by R. J. marketed by Reynolds Tobacco Company, GRIZZLY moist tobacco products, as marketed by American Snuff Company, LLC, and MARLBORO snus, as marketed by Philip Morris.

When the tobacco-containing material 41 is a loose tobacco product, the amount of tobacco product stored in the upper storage compartment 29 of a representative container 10 can also vary. Typically, for example, the amount of stored moist tobacco product varies from about 20 g to about 50 g, and most often about 30 g to about 40 g and may be embodied in loose form. When the tobacco-containing material 41 is a pouched or snus-type of product, the number of solid product units stored in a representative container can also vary, and will depend upon factors such as the size of the container 10, the size of the product units, the degree of container fill, and the like. Typically, the number of stored pouched product units will vary from about 5 to about 30, more typically about 10 to about 25, and often about 15 to about 20.

The environment modification material 25 can vary. The environment modification material 25 can be selected so as to provide for alteration or control of the atmosphere within the sealed container 10. For example, the environment modification material 25 can be a selected so as to control the level of certain gases, such as oxygen or carbon dioxide, within the container 10. The environment modification material 25 also can have the form of a humidity control device or formulation, and as such, the degree of moisture within the sealed container 10 can be controlled. As such, the environment modification material 25 can be a selected from materials or formulations that have desiccant properties. Alternatively, a preferred humidity control device is of the type set forth in U.S. Pat. No. 6,921,026 to Saari et al, which is incorporated by reference in its entirety herein. In one embodiment the environment modification material 25 may be configured to provide moisture to or remove moisture from the atmosphere in the container, depending on the level of humidity in the atmosphere in the container. An example embodiment of such an environment modification material is sold under the trade name BOVEDA PACK by Serious Cigars of Houston, Tex. As yet another example of a suitable environment modification material 25 is a material that is capable of imparting sensory attributes, such as flavor or aroma characteristics, to the tobacco-containing material 41 that is stored within the sealed container 10. For example, the environment modification material 25 can be comprised of volatile flavor and aroma substances carried by a substrate material that provides for controlled release of those volatile substances. Various other examples of environmental modification materials include ion exchange materials (e.g., resins), preservatives, desiccants, and aromatic materials.

The environment modification material 25 may be embodied in a number of different forms. For example, the environment modification material 25 may comprise beads (e.g., alumina beads), films (e.g., impregnated films), loose material, material in a package (e.g., a fabric package), material in a packet (e.g., a porous paper packet), or a sachet, plastic materials, sponges, sponge-type material, carbon materials (e.g., charcoal), etc. The amount of environment modification material 25 that is incorporated into the container can vary. The amount of environment modification material 25 may range from about 10 g to about 50 g and preferably from about 15 g to about 30 g.

The relative dimensions of the upper internal storage compartment 29 and lower internal storage compartment 26 of the lower body portion 20 of the container 10 can vary. For example, the ratio of the volume of the upper internal storage compartment 29 to that of the lower internal storage compartment 26 of a sealed container 10 can range from about 6:1 to about 2:1, and most often about 5:1 to about 3:1.

As noted above, in one embodiment the environment modification material 25 may be configured to control a humidity level within the container 10. In this regard, it may be desirable to maintain the relative humidity within the upper internal storage compartment 29 of the container 10 from about 20% to about 90%. By way of example, snus may preferably be stored at a relative humidity from about 25% to about 35%. Moist snuff may preferably be stored at a relative humidity of about 75% to about 90%. Accordingly, the environment modification material 25 may be configured to maintain relative humidity levels within the upper internal storage compartment 29 within these ranges when such tobacco-containing materials 41 are received therein. In this regard, as noted above, the environment modification material 25 may be configured to provide moisture to and/or remove moisture from the atmosphere in the container 10, depending on the level of humidity in the atmosphere in the container, such that the relative humidity level in the upper internal storage compartment 29 falls within a desired range.

Referring to FIG. 2, there is shown an enlarged view of a representative sealing mechanism suitable for a lower body portion 20 according to an embodiment of the present disclosure. Projecting from the outer peripheral surface 27 of the body 20 (and when provided, a neck region 34) is a circumferential rib structure 60 configured to form a seal with the cover 21 (see, FIG. 1). In some aspects, the rib structure 60 may be integrally formed with the side wall 24 of the body 20, such as, for example, when the body 20 is formed by a plastic injection molding process. In other instances, the rib structure 60 may be a separate and discrete component secured or otherwise affixed to the side wall 24 with appropriate mechanical fasteners or adhesive (e.g., an epoxy adhesive). For example, the rib structure 60 may be formed by a plurality of rib segments 62 arranged in spaced relation around the periphery of the side wall 24 of the body 20 (e.g., positioned circumferentially about the side wall 24 of the body 20 where the container body is cylindrical). Any number of rib segments 62 may be provided in accordance with the present disclosure (e.g., often about 2 to about 20 rib segments, and frequently about 5 to about 15 rib segments), although a preferred embodiment includes about 8 to about 12 rib segments.

Each rib segment 62 is separated from the next by a vent channel 64. Each rib segment 62 may include a rib wall 66 and a rib projection 68. In some instances, the rib projection 68 may extend along the entire width of an end of the rib wall 66 disposed proximate to the open end of the body 20. The rib walls 66 have a thickness so as to extend from the outer peripheral surface 27 in such a manner that the lateral ends thereof form the vent channels 64 between adjacent rib segments 62. In other words, each rib segment 62 is raised in comparison to the adjacent exterior surface 27 of the side wall 24 such that channels 64 are formed between the rib segments. When the cover 21 (see, FIG. 1) is engaged with the body 20, each pair of adjacent rib segments 62 forms a vent channel 64 between the lower body and the cover that allows venting from the interior of the sealed container 10 to the atmosphere exterior of the container. The vent channels 64 extend between a top edge 69 of the side wall 24 downwardly past rib segments 62 to a lip 32. In this regard, a plurality of bumps or protrusions 70 may be positioned on the top edge 69 of the body 20. Thereby, the protrusions 70 may separate the cover 21 from the top edge 69 of the body 20 such that air may flow therebetween and through the vent channels 64. Such vent channels 64 provide proper venting when the cover 21 (see, FIG. 1) is fully seated on the body 20. Exemplary dimensions for the vent channels 64 include heights in the range of about 6.9 millimeters to about 7.2 millimeters, and depths in the range of about 0.1 millimeters to about 0.2 millimeters.

In some instances, the upper portion 30 of the side wall 24 may define the lip 32 in such a manner that the upper portion 30 of the side wall has a neck region 34 of reduced diameter (as compared to the diameter of the remainder of the outer surface of the side wall). The location of the lip 32 along the side wall 24 of the body 20 can vary, meaning that distance between the lip 32 and the top edge 38 of the body 20 can be a matter of design choice.

The rib projections 68 project radially outward from the outer peripheral surface 27 and the neck region 34 (when provided). Although the rib projections 68 are shown in spaced relation to the top edge 69 of the body 20, the position of the rib projections may vary in relation to the top edge, meaning the rib projection could be moved closer or further away from the top edge. In some instances, the rib projections 68 have a substantially arcuate or rounded profile, although other configurations may also be employed, such as, for example, a configuration in which the rib projection 68 terminate at a substantially sharp edge (not shown) outward of the outer peripheral surface 27.

The body 20 also possesses an intermediate bottom wall 28 that possesses a series of perforations 39 that provide for air passage to regions below that wall. Together with the side wall 24, the intermediate bottom wall 28 defines an upper compartment 29 in which the tobacco-containing material 41 (e.g., smokeless tobacco material) is positioned.

FIG. 3 shows an enlarged cross-sectional view of an upper portion of a representative sealed container 10. The container 10 possesses a body 20 and a cover 21. The rib projections 68 interact with the peripheral flange 44 of the cover 21 in an interference fit when the cover is positioned over the side wall 24 of the body 20, so as to form a seal therebetween. In this regard, the rib projections 68 force the peripheral flange 44 outward (e.g., such that the peripheral flange aligns with or extends outward of the outer peripheral surface 27 of the body 20) to form a tight interference fit when the cover 21 is engaged with the body 20.

Exemplary dimensions for the rib projections 68 include heights in the range of about 0.05 millimeters to about 0.25 millimeters, and widths in the range of about 1 millimeter to about 1.5 millimeters. As used herein, height refers to the major dimension of the rib projection 68 that extends from the side wall 24, as indicated by reference character A. Rib projections 68 may be positioned below the top edge 69 of the side wall 24 in the range of about 1.5 millimeters to about 2.0 millimeters below the top edge.

In instances where the lip 32 is provided on the body 20, an edge 46 of the peripheral flange 44 may interact with a surface 36 of the lip 32 to form a stop when the cover 21 is received upon the body 20. In other words, the edge 46 of the cover 21, which is typically substantially planar, abuts the surface 36 of the lip 32 (which is also typically substantially planar) when the cover 21 is fully seated upon the body 20. However, in some embodiments the lip 32 and/or the edge 46 of the peripheral flange 46 may include channels, gaps, or other features configured to allow for venting from the vent channels 64 to the exterior of the container 10. Alternatively, the lip 32 may be slightly displaced from the edge 46 of the peripheral flange 44 when the cover 21 is received on the body 20 to allow for venting from the vent channels 64 to the exterior of the container 10. The cylindrical outer surface 48 of the cover 21 may typically have the same approximate size or diameter as the side wall 24 of the body 20, such that the cover 21 and the body 20 form a smooth exterior surface when the cover is placed over the neck region 34 of the side wall and fully seated upon the body. Hence, the sealed container 10 may be compact and flat so as to be suitable for storage and transportation by a user.

In some instances, the rib structure 60 may be positioned adjacent to the lip 32, wherein the peripheral flange 44 of the side wall 24 can engage the rib projections 68 in such a manner that the outer peripheral surface 27 of the body 20 is substantially flush with the outer surface 48 of the cover 21. In other words, in some instances, the peripheral flange 44 of the cover 21 may not be deflected by the rib structure 60 to such a degree that causes the peripheral flange 44 to extend outwardly beyond the lip 32.

Referring to FIG. 4, there is shown a top view of the intermediate bottom wall 28 of the body 20 of the container 10 showing a representative configuration of the perforations 39 therein. As illustrated, in one embodiment the perforations 39 may be provided through the intermediate bottom wall 28 such that the outer perimeter of the intermediate bottom wall is continuous, without the perforations extending therethrough.

Referring to FIG. 5, there is shown a top view of the intermediate bottom wall 28 of the body 20 of the container 10 showing an alternative representative configuration of the perforations 39 in that wall. As illustrated, in this embodiment the perforations 39 extend through the outer peripheral edge of the intermediate bottom wall 28.

Accordingly, the perforations 39 may be positioned at a variety of locations within the intermediate bottom wall 28. Further, various quantities, sizes, and shapes of the perforations 39 may be employed. Other types of perforations include, e.g., through holes extending through a screen or a layer of fabric. However, any of various embodiments of the intermediate bottom wall 28 and the perforations 39 may be employed so long as the intermediate bottom wall is configured to prevent the environment modification material 25 from entering the upper compartment 29, prevent the tobacco-containing material 41 from entering the bottom compartment 26, and allow the environment modification material to affect the atmosphere within the upper compartment (e.g., by allowing airflow between the lower compartment and the upper compartment).

Referring to FIG. 6, there is shown a representative configuration of the bottom wall 22 that is sealed to the remaining portion of the bottom body 20 of the container 10. Most preferably, the bottom wall 22 is a separate piece that is attached to the remainder of the body portion 20 of the container 10 so as to seal the environment modification material 25 within the bottom compartment 26, and hence to remain closed. Most preferably, the bottom wall 22 is attached to the remaining bottom portion of the body portion 20 so that the bottom wall is not readily removable or is not prone to being opened without significant effort. In this regard, the bottom wall 22 may be hermetically sealed to the remainder of the body portion 20. For example, the bottom wall 22 may be retained in the closed configuration via one-way hooks, hinges, rivets, adhesives, welds (e.g., ultrasonic welds, foil laminate ultrasonic welds, friction stir welds), etc., or any combination thereof. Examples of hermetic sealing and various other permanent joint arrangements are disclosed, by way of example, in PCT Application WO 2009068915 A2 to Warwick et al. and EP 0813946 A1 to Davis et al., which are incorporated herein by reference in their entireties. An example embodiment of an induction sealing process involving an induction sealing process for welding foil laminates, which may be employed in accordance with embodiments of the present disclosure, is available from Enercon Industries Corporation of Menomonee Falls, Wis.

FIG. 7 illustrates an alternate embodiment of the of the intermediate bottom wall 28. As illustrated, the intermediate bottom wall 28 may include perforations 39 extending therethrough. Accordingly, the intermediate bottom wall 28 may allow for passage of air therethrough as discussed above. Further, the intermediate bottom wall 28 may include an aperture 72 extending therethrough, for example at a center thereof.

FIG. 8 illustrates an alternate embodiment of the container 10 including the intermediate bottom wall 28 illustrated in FIG. 7. As illustrated, the intermediate bottom wall 28 may include a transverse wall 74 extending substantially perpendicularly to the remainder of the intermediate wall. The transverse wall 74 may thus cause the lower compartment 26 to define an annular ring shape. Further, an extension 76 of the upper compartment 29 may be surrounded by the transverse wall 74. Accordingly, the extension 76 of the upper compartment 29 may provide more space in which to receive the tobacco-containing material 41. Further, the transverse wall 74 may include the perforations 39 extending therethough. In this regard, the transverse wall 74 may include perforations 39 extending transversely to the perforations in the remainder of the bottom wall 28 in some embodiments. Alternatively, only the transverse wall 74 may include the perforations 39. Including perforations 39 in the transverse wall 74 may be desirable in that it may provide additional airflow therethrough, and these perforations may be less prone to blockage due to the transverse orientation, such that gravity may not press the tobacco-containing material 41 into contact therewith in horizontal orientations of the container. Conversely including perforations 39 extending in two directions (e.g., through the transverse wall 74 and the remainder of the intermediate bottom wall) may resist blockage of the perforations in both horizontal and vertical orientations of the container 10.

FIGS. 9 and 10 illustrate an additional embodiment of the container 10. More particularly, FIG. 9 is a partial cut-away perspective view of the container 10 and FIG. 10 is a bottom sectional view through the container. As illustrated, the container 10 includes a bottom portion 20 and a lid 21. An intermediate wall 28 divides a space inside of the bottom portion 20 into a first compartment 29 and a second compartment 26. The first compartment 29 may be configured to receive a tobacco-containing material 41, and the second compartment 26 may be configured to receive an environment modification material 25.

The intermediate wall 28 may extend around the periphery of the first compartment 29 (e.g., extending around the circumference thereof in the illustrated embodiment) such that the second compartment 26 surrounds the periphery of the first compartment (e.g., surrounding the circumference thereof in the illustrated embodiment). Use of such a configuration may hide the second compartment 26 from a consumer, such that a consumer does not know of, and thereby does not attempt to gain access to, the second compartment. In this regard, the top of the intermediate wall 28 may be integrally formed with, or otherwise coupled to, the remainder of the bottom portion 20 such that second compartment 26 is sealed at the top and a consumer may not view into the second compartment. Further, the second compartment 26 may be enclosed at a bottom thereof by the bottom wall 22 in some embodiments.

In one embodiment the spacing between the side wall 24 and the intermediate wall 28 may be from about 0.125 inches to about 0.5 inches, and preferably about 0.25 inches. Accordingly, the distance between the side wall 24 and the intermediate wall 28 may be relatively small. As noted above, this may further conceal the presence of the second compartment 26.

The intermediate wall 28 may include passageways or perforations 39 that allow the environmental modification material 25 to act through the intermediate wall upon an atmosphere within the first compartment 29. The perforations 39 may be positioned within the intermediate wall 28 at locations from a top to a bottom of the intermediate wall in one embodiment. Alternatively, as illustrated, the perforations 39 may be separated from the bottom wall 22 (e.g., spaced therefrom from about 0.25 inches to about 1 inch and preferably about 0.5 inches) in some embodiments. Such a spacing may be configured to prevent any tobacco-containing material 41 (e.g., crumbs or particles thereof) from entering the perforations 39, such that the perforations do not become blocked and the tobacco-containing material does not enter the second compartment.

Referring to FIG. 11, there is shown an alternative embodiment of a container 10 according to the present disclosure. There is shown a container 10 of the type set forth in U.S. Pat. No. D649,284 to Patel et al. and U.S. patent application Ser. No. 13/739,776 to Pipes et al., filed Jan. 11, 2013, which are incorporated by reference herein. The cover 21 is shown as being as applied to the bottom portion 20, and hence that container is shown in a sealed position. The bottom portion 20 possesses lower compartment 26 into which environment modification material 25 is positioned. The upper region of the lower compartment 26 has the form of an intermediate bottom wall 28 that possesses at least one perforation, opening or air passageway 39. A portion of the bottom wall 22 of the container possesses the form of a door or flap 80 which is shown as open, but is configured to be sealed shut to maintain the environment modification material 25 sealed in the lower compartment 26. In this regard, the flap 80 may be configured to be substantially irreversibly shut in some embodiments, such that a user may not remove the flap during ordinary use thereof. For example, the flap 80 may be retained in the closed configuration via one-way hooks, hinges, rivets, adhesives, welds (e.g., ultrasonic welds, foil laminate ultrasonic welds, and friction stir welds), etc., or any combination thereof. Further, the flap 80 may be hermetically sealed to the remainder of the bottom wall 22. Examples of hermetic sealing and other permanent coupling arrangements are disclosed, by way of example, in PCT Application WO 2009068915 A2 to Warwick et al. and EP 0813946 A1 to Davis et al., which are incorporated herein by reference in their entireties. An example embodiment of an induction sealing process involving an induction sealing process for welding foil laminates, which may be employed in accordance with embodiments of the present disclosure is available from Enercon Industries Corporation of Menomonee Falls, Wis.

As part of the final packaging process, once the containers of the disclosure are filled with the desired amount smokeless tobacco product or other tobacco-containing material, the containers are sealed (i.e., after the cover is properly placed over the body portion), and the sealed containers optionally can be further sealed with a circumferential label or wrapper of a pervious or impervious material. The label or wrapping material can vary. Typically, the selection of the packaging label or wrapper is dependent upon factors such as aesthetics, desired barrier properties (e.g., so as to provide protection from exposure to oxygen, or so as to provide protection from loss of moisture), or the like.

Note that while embodiments of containers are described herein and illustrated in the drawings, these embodiments are provided for example purposes only. In this regard, the containers of the present disclosure may embody any of various configurations in which a container includes two chambers separated by a barrier (e.g., a semipermeable barrier) configured to prevent movement of a product from one chamber to the other while allowing for environmental exchange between the chambers. Accordingly, the configurations of the containers incorporating aspects of the present disclosure may differ from the particular example embodiments disclosed herein. For example, the two chambers may be one on top of the other, beside each other, or configured in any of various other manners.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

What is claimed is:

1. A container defining a modified internal environment, the container comprising:

a cover;

a body portion configured to engage the cover to substantially enclose an internal space defined by the body portion, the body portion comprising a side wall, a bottom wall and an intermediate wall, the intermediate wall dividing the internal space into a first compartment and a second compartment; and an environment modification material received in the second compartment and configured to act through the intermediate wall upon an atmosphere within the first compartment, the environment modification material providing moisture and removing moisture from the atmosphere within the container, depending on a level of humidity in the atmosphere in the container, in order to maintain a relative humidity in the container;

wherein the cover is configured to releasably engage the body portion such that the first compartment is accessible and the intermediate wall and the bottom wall are irreleasably secured to the side wall such that the second compartment is inaccessible.

2. The container of claim 1, wherein the second compartment is defined by the side wall, the bottom wall, and the intermediate wall.

3. The container of claim 1, wherein the intermediate wall comprises a plurality of through holes extending therethrough.

4. The container of claim 1, wherein the cover cooperates with the body portion to define a plurality of vent channels extending between the first compartment and an external atmosphere.

5. The container of claim 1, wherein the environment modification material provides and removes moisture from the atmosphere within the container in order to maintain the relative humidity within the container from about 20 percent to about 90 percent.

6. The container of claim 5, wherein the relative humidity within the container is maintained from about 25 percent to about 35 percent.

7. The container of claim 5, wherein the relative humidity within the container is maintained from about 75 percent to about 90 percent.

8. A container for a tobacco-containing material, the container comprising:

a lower body portion and a top cover, the lower body portion comprising a bottom wall, an intermediate bottom wall located above the bottom wall, and a side wall extending upwardly therefrom, the bottom wall and the side wall of the lower body portion defining a lower internal storage compartment including an environment modification material, the intermediate wall and the bottom wall being irreleasably secured to the side wall such that the lower internal compartment is inaccessible, the intermediate bottom wall and the side wall of the lower body portion defining an upper internal storage compartment configured to receive a tobacco-containing material, the intermediate bottom wall being adapted to allow for atmosphere within the lower body portion to pass between the lower internal storage compartment and the upper internal storage compartment such that the environment modification material provides moisture and removes moisture from the atmosphere in the container, depending on a level of humidity in the atmosphere, in order to maintain a relative humidity in the container;

the side wall of the lower body portion having an outer peripheral surface, the outer peripheral surface being configured at an upper portion to allow removable engagement of the top cover such that the upper internal storage compartment is accessible, the top cover having a top wall and a side wall extending downwardly therefrom, the top cover being configured to be removably engaged with the lower body portion, the side wall of the top cover having an inner surface, the inner surface being configured to be received over and releasably engage the outer peripheral surface of the side wall of the lower body portion.

9. The container of claim 8, wherein the lower body portion comprises a polymeric material, and the top cover comprises a metallic material.

10. The container of claim 8, wherein the lower body portion further comprises a rib structure, the intermediate bottom wall and the rib structure each being integrally formed with the side wall of the lower body portion.

11. The container of claim 10, wherein the outer peripheral surface of the side wall of the lower body portion defines a lip, the rib structure being positioned adjacent to the lip such that a peripheral flange of the top cover interacts with the lip to form a stop when the top cover is received over the outer peripheral surface of the side wall of the lower body portion.

12. The container of claim 11, wherein the peripheral flange comprises a substantially planar edge configured for abutting contact with a substantially planar surface of the lip when the top cover is fully seated upon the lower body portion.

13. The container of claim 11, wherein the side wall and the peripheral flange of the lower body portion are substantially cylindrical, and the rib structure extends circumferentially about the outer peripheral surface of the side wall of the lower body portion.

14. The container of claim 11, wherein the rib structure comprises a plurality of rib segments projecting from the outer peripheral surface of the side wall of the lower body portion, the rib segments being spaced apart so as to form vent channels therebetween for facilitating venting when the top cover is received over the lower body portion.

15. The container of claim 14, wherein each of the rib segments comprises a rib wall and a rib projection projecting from the rib wall, the rib wall being adjacent the outer peripheral surface of the side wall of the lower body portion, and the rib projection extending outwardly of the rib wall and being configured to interact with the inner surface of the peripheral flange when the top cover is received over the outer peripheral surface of the side wall of the lower body portion.

16. The container of claim 8, further comprising at least one of a plurality of pouched smokeless tobacco products and a tobacco material in the form of moist snuff received in the upper internal storage compartment.

17. A packaged tobacco product, comprising:

a cover;

a body portion engaged with the cover, the body portion defining an internal space and comprising a side wall, a bottom wall and an intermediate wall, the intermediate wall dividing the internal space into a first compartment and a second compartment, the first compartment comprising a tobacco-containing material received therein, and the second compartment comprising an environment modification material received therein and configured to act upon an atmosphere within the first compartment to provide moisture and remove moisture from the atmosphere in the packaged tobacco product, depending on a level of humidity in the atmosphere, in order to maintain a relative humidity in the packaged tobacco product;

wherein the cover is releasably secured to the body portion such that the first compartment is accessible and the intermediate wall and the bottom wall are irreleasably secured to the side wall such that the second compartment is inaccessible.

18. The packaged tobacco product of claim 17, wherein the intermediate wall comprises a plurality of through holes extending therethrough.

19. The packaged tobacco product of claim 17, wherein the cover cooperates with the body portion to define a plurality of vent channels extending between the first compartment and an external atmosphere.

* * * * *